US006658702B1

(12) United States Patent
Tucherman

(10) Patent No.: US 6,658,702 B1
(45) Date of Patent: Dec. 9, 2003

(54) WRITING IMPLEMENT HOLDER WITH CLIP

(76) Inventor: Leonardo Tucherman, Rua Xavier Da Silvira 118/1001, Rio de Janeiro (BR), 22061-010

( * ) Notice: Subject to any disclaimer, the term of this patent is extended or adjusted under 35 U.S.C. 154(b) by 0 days.

(21) Appl. No.: 10/217,173

(22) Filed: Aug. 12, 2002

(51) Int. Cl.[7] ..... B43K 23/04

(52) U.S. Cl. ..... 24/11 CT; 24/3.7; 211/69.1

(58) Field of Search ..... 24/10 R, 11 FE, 24/11 PP, 11 CC, 11 CT, 11 HC, 11 S, 11 F, 11 M, 11 P, 10 A, 3.2, 3.7; 30/123; 211/69.1, 69.3, 69.5

(56) References Cited

U.S. PATENT DOCUMENTS

| | | | | | |
|---|---|---|---|---|---|
| 1,816,049 | A | * | 7/1931 | Larner | 206/496 |
| 2,412,938 | A | * | 12/1946 | Amoth | 211/69.5 |
| 2,472,344 | A | * | 6/1949 | Rosenbarger | 24/3.7 |
| 3,597,802 | A | | 8/1971 | White | |
| 3,627,182 | A | | 12/1972 | Calkins | |
| 3,964,134 | A | | 6/1976 | Newtson | |
| 4,949,850 | A | * | 8/1990 | Weathers | 211/69.7 |
| 5,184,375 | A | | 2/1993 | Hoyt | |
| 5,226,625 | A | * | 7/1993 | Hanna | 248/222.13 |
| 5,308,178 | A | * | 5/1994 | Jiang | 401/8 |
| 5,350,061 | A | * | 9/1994 | Gunn | 206/214 |
| 5,372,403 | A | * | 12/1994 | Puerto | 297/188.17 |
| 5,388,688 | A | * | 2/1995 | Kiiski | 206/214 |
| 5,640,743 | A | | 6/1997 | Greene et al. | |
| 5,718,023 | A | | 2/1998 | Billish | |
| 5,845,889 | A | * | 12/1998 | Suzuki | 248/451 |
| 6,000,103 | A | | 12/1999 | Paice et al. | |
| 6,021,891 | A | * | 2/2000 | Anderson | 206/214 |
| D433,063 | S | | 10/2000 | Fong | |
| 6,471,290 | B1 | * | 10/2002 | Moody et al. | 297/188.2 |
| 6,530,509 | B1 | * | 3/2003 | Davis | 224/219 |

* cited by examiner

*Primary Examiner*—Anthony Knight
*Assistant Examiner*—André L. Jackson
(74) *Attorney, Agent, or Firm*—Dale J. Ream

(57) ABSTRACT

A writing implement holder includes a case having a bottom wall, upstanding front and back walls, and side walls, and defining an open top. A lid is pivotally mounted to the case for selective movement between open and closed configurations. A clip member is attached to the lid for selectively attaching the case to a planar surface such as a music stand. The lid includes longitudinally extending channels slidably coupled to guide pins mounted to respective case side walls. The guide pins provide an axis about which the lid is pivotally movable between open and closed configurations. The channels enable the lid to be slidably moved to a locked configuration.

17 Claims, 6 Drawing Sheets

WRITING IMPLEMENT HOLDER WITH CLIP

BACKGROUND OF THE INVENTION

The present invention relates generally to pen and pencil holders and, more particularly, to a writing implement holder having a pivotal and slidable lid that is selectively attachable to another object and which does not interfere with the function of the object to which it is attached.

Various devices have been proposed for holding pens and pencils as well as holders that are attachable to other objects. Although assumably effective for their intended purposes, existing devices do not provide a holder for multiple writing implements that may be clipped to a planar surface without impeding use of that object. For example, the existing devices are not suitable for attachment to the lip of a music stand for providing convenient access to a pencil and eraser and not interfering with the turning of music pages.

Therefore, it is desirable to have a writing implement holder that may be releasably attached to a planar surface. Further, it is desirable to have a writing implement holder having a lid that may be pivotally moved between open and closed configurations for use and storage, respectively. In addition, it is desirable to have a writing implement holder having its own pencil sharpener and shavings receptacle.

SUMMARY OF THE INVENTION

A writing implement holder according to the present invention includes a generally rectangular case having a bottom wall, upstanding front and back walls, and case side walls extending between the front and back walls. The case defines an open top through which writing accessories may be inserted or removed. The implement holder includes a lid that is pivotally movable between a closed configuration covering the open top of the case and an open configuration exposing the open top. Side walls of the lid define channels that cooperate with guide pins on the case side walls for longitudinal movement of the lid. The guide pins also define a lateral axis about which the lid may be selectively pivoted between open and closed configurations. The lid side walls also define recesses that may selectively receive lock pins situated on the case side walls. When the lid is pivoted to an open configuration and slidably moved to a locking configuration, the locking pins are snappably received into the locking recesses. A clip member is attached to the lid for attaching the entire holder to a planar surface, such as the lip of a music stand. When the lid is positioned at the open and locked configurations and the clip member is attached to a music stand, the contents of the holder are readily accessible to a user and the use of the music stand is not impaired.

Therefore, a general object of this invention is to provide a writing implement holder that holds a variety of writing implements in conveniently accessible positions.

Another object of this invention is to provide a writing implement holder, as aforesaid, which may be attached to another object without impeding use of that object.

Still another object of this invention is to provide a writing implement holder, as aforesaid, having an integral pencil sharpener and removable pencil shavings receptacle.

Yet another object of this invention is to provide a writing implement holder, as aforesaid, having a lid which may be releasably locked in an open configuration.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 3:
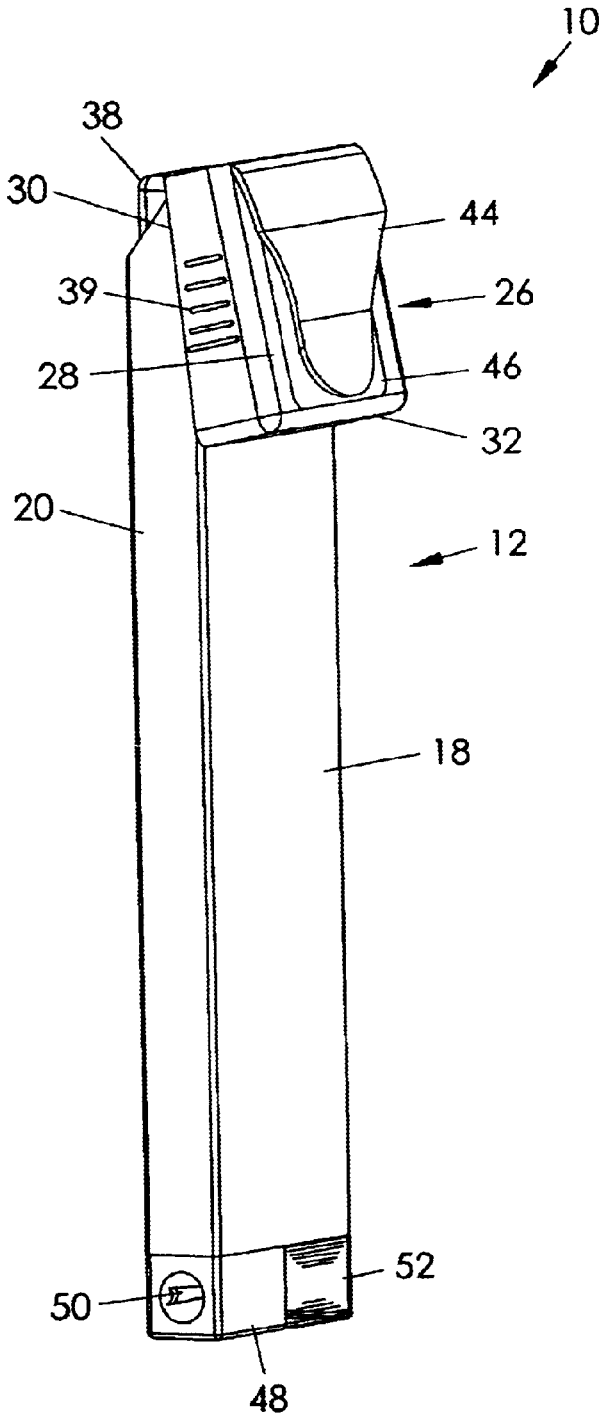
FIG. 3 is a rear perspective view of the writing implement holder as in FIG. 1 in an open configuration.
Figure 4:
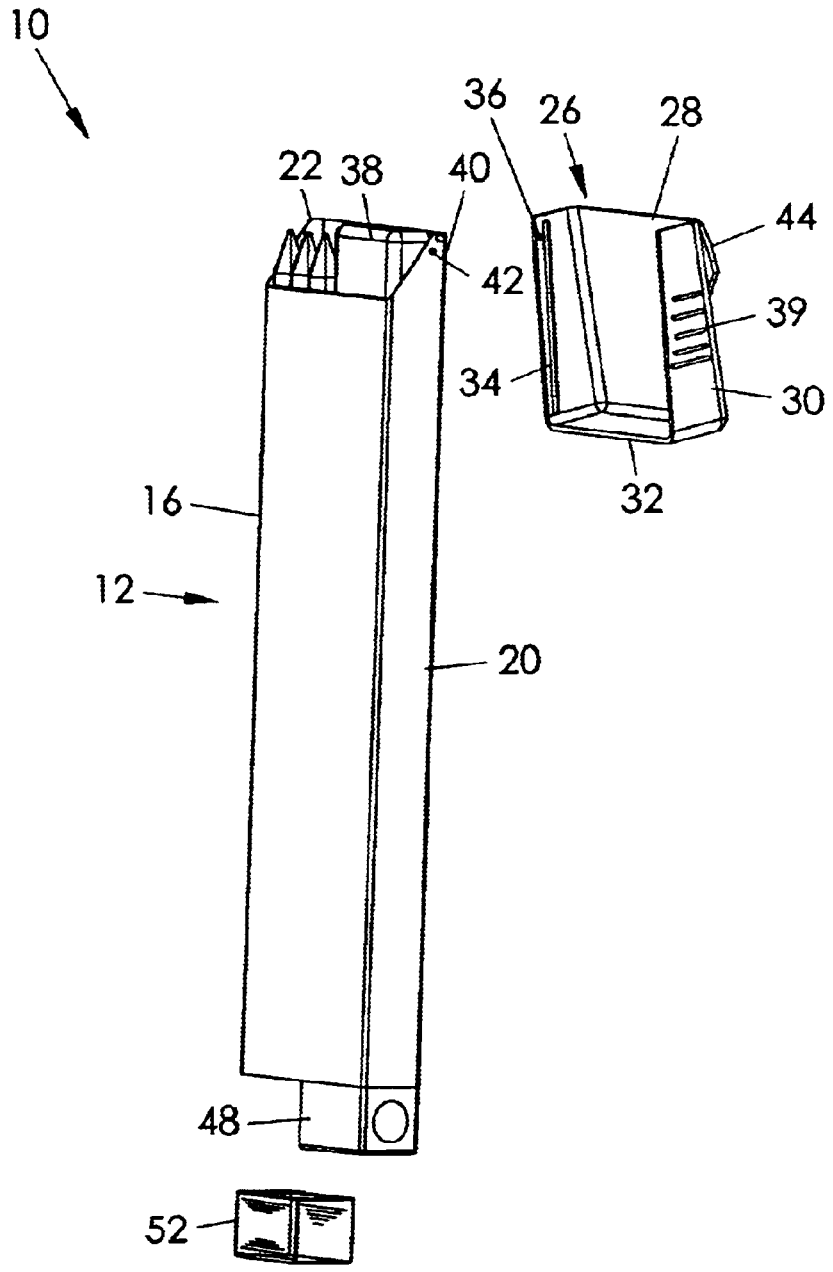
FIG. 4 is an exploded view of the writing implement holder as in FIG. 2.

A writing implement holder with clip attachment according to the present invention will now be described in detail with reference to FIGS. 1 through 6 of the accompanying drawings. A writing implement holder 10 according to one embodiment of the present invention is shown particularly in FIGS. 1 through 4. The implement holder 10 includes a case 12 having a generally rectangular configuration including a bottom wall 14 with front 16 and back 18 walls extending upwardly therefrom with spaced apart opposed case side walls 20 connecting the front 16 and back 18 walls (FIG. 4). The back wall 18 includes a length that is greater than a length of the front wall 16 such that top edges of respective case side walls are downwardly sloped from the back wall 18 to the front wall 16 (FIG. 4). This allows writing implements stored within the interior space of the case 12 to be more easily removed from or inserted into the case 12.

Figure 6:
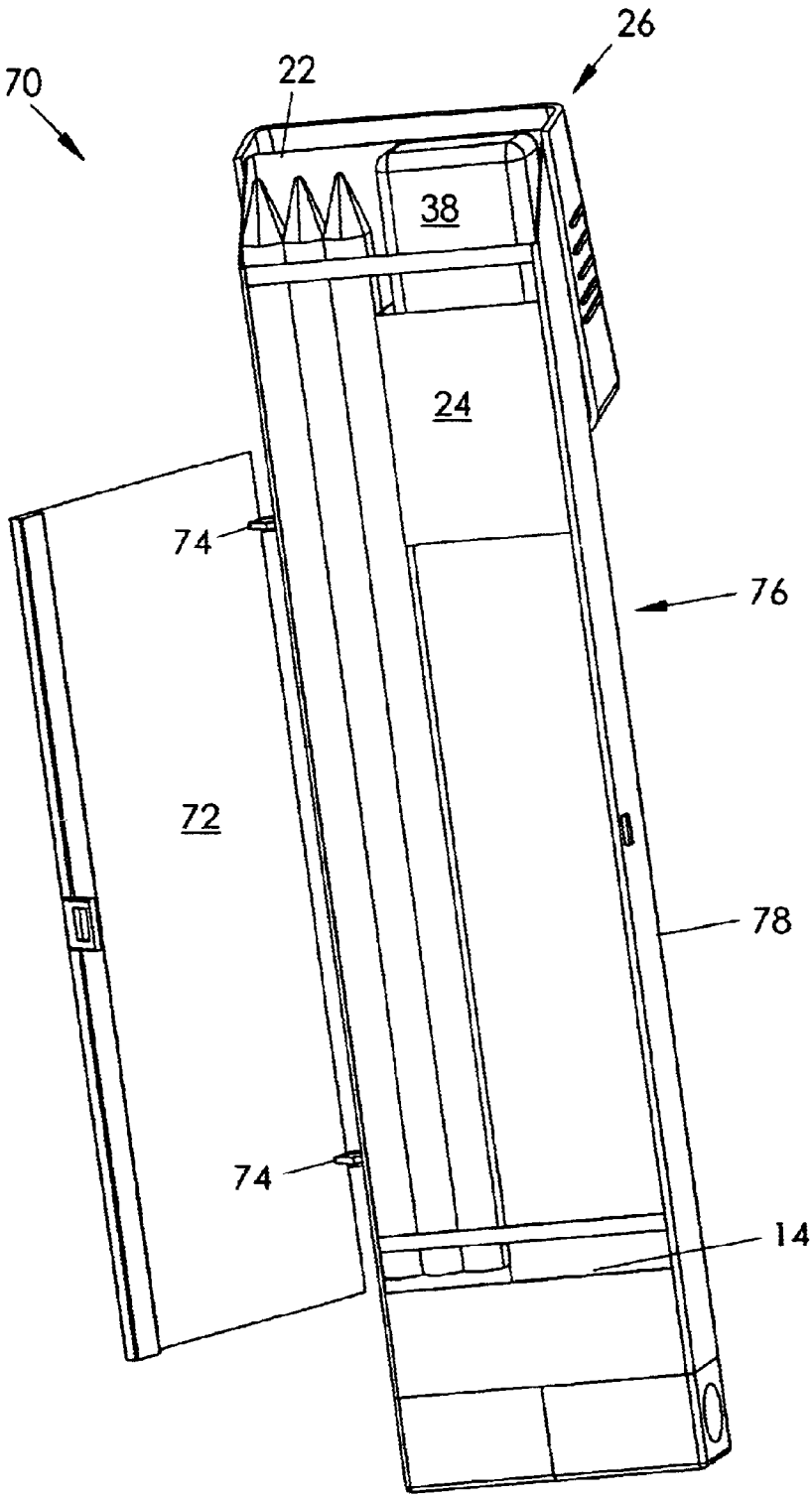
FIG. 6 is a perspective view of a writing implement holder according to yet another embodiment of the present invention.

The walls of the case 12 define a generally hollow interior space and an open top 22. The configuration of the interior space is best shown in FIG. 6. The interior space is divided into a first portion that is open between the bottom wall 14 and the open top 22, the first portion being particularly suited to hold a plurality of standard sized pencils. The second portion includes a bracket 24 having a construction capable of receiving a portion of an eraser 38 therein and supporting the eraser 38 adjacent the open top 22 of the case 12.

The writing implement holder 10 includes a lid 26 that is pivotally movable between open and closed configurations so as to selectively cover or expose the open top 22. More particularly, the lid 26 includes a face plate 28 having opposing lid side walls 30 depending from opposed longitudinal edges of the face plate 28 (FIG. 4). The lid 26 includes an end wall 32 extending between corresponding first ends of the lid side walls 30. The lid 26 defines an open end between second ends of the lid side walls 30.

A pair of guide pins 40 are fixedly mounted to respective case side walls 20, each guide pin being positioned adjacent the open top and the back wall 18 of the case 12 and being generally perpendicular to its respective case side wall 20 (FIG. 4). In other words, each guide in 40 is positioned in the upper-rear corner of its corresponding case side wall 20. Further, the inner surface of each lid side wall 30 defines an elongate channel 34 extending longitudinally therealong. Preferably, each channel is a groove defined by the lid side wall although it is understood that a track construction would also be suitable. The channels 34 are snappably coupled to the guide pins 40 such that the lid 26 may be slidably moved in relative back and forth motion.

A pair of lock pins 42 are also mounted to respective case side walls 20 (FIG. 4). Each lock pin 42 is situated adjacent the top edge of a respective case side wall 20 and generally adjacent a respective guide pin 40. Correspondingly, each lid side wall 30 defines a recess 36 substantially adjacent a corresponding distal end thereof relative to the lid end wall 32. In other words, the lock pins 42 will be releasably captured by corresponding recesses 36 when the lid 26 is slidably moved such that the guide pins 40 are situated at the channel ends opposite the lid end wall 32 (FIG. 3). The outer surface of each lid side wall 30 includes a grip surface 39, such as a plurality of nubs or a rubber layer.

A clip member is mounted to the face plate 28 of the lid 26 (FIG. 3). Preferably, the clip member 44 includes a plastic construction having a first end fixedly attached to the face plate adjacent its open end and a free second end adjacent the lid end wall 32. The clip member 44 includes a contoured configuration. The construction of the clip member 44 enables it to receive the planar surface of an external object between its free end and the outer surface of the face plate 28 such that the planar surface is held therein in a friction-fit relationship. Further, a magnet 46 may be fixedly attached to the outer surface of the face plate 28 between the face plate 28 and the clip member 44. The magnetic attraction further inhibits movement of the writing implement holder 10 when clipped to a planar surface having a metallic construction.

The writing implement holder 10 further includes a pencil sharpener 48 fixedly attached to the bottom wall 14 of the case 12 (FIG. 3). Of course, the pencil sharpener 48 could also be mounted to another portion of the case 12. The pencil sharpener 48 includes a conventional construction having a metal blade 50 situated therein for sharpening a pencil inserted therein. A receptacle 52 having a transparent housing is coupled to the bottom wall 14 of the case 12 in a friction-fit relationship such that it can be easily removed and replaced. The receptacle includes an open end for communication with the pencil sharpener 48 for receiving pencil shavings therein. Thus, the receptacle 52 may be selectively removed when it needs to be emptied.

Figure 1:
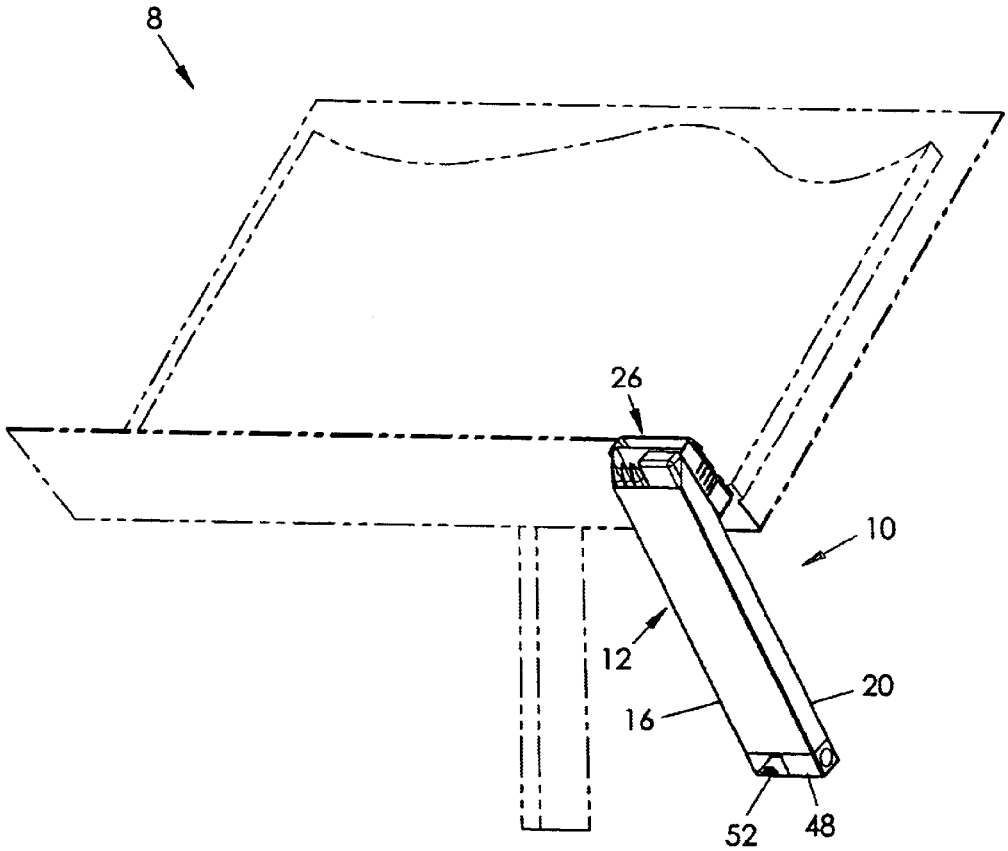
FIG. 1 is a perspective view of a writing implement holder according to one embodiment of the present invention in use on a music stand.
Figure 2:
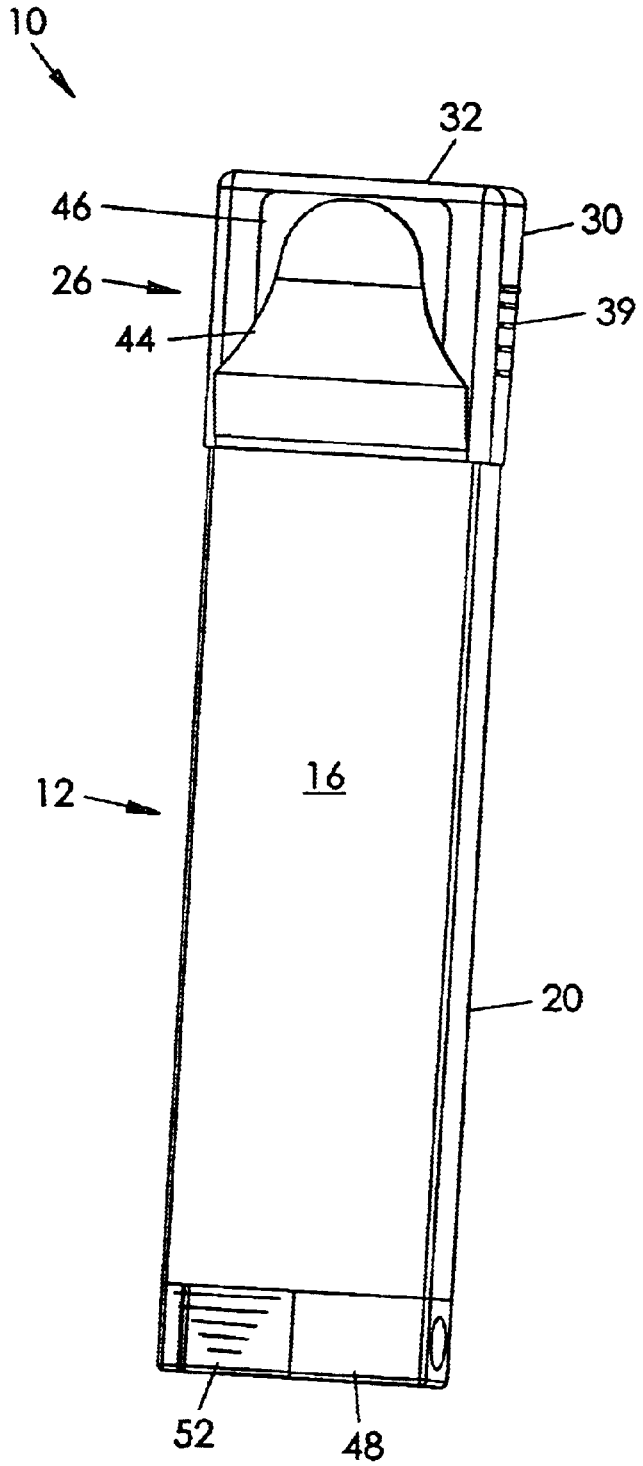
FIG. 2 is a front perspective view of the writing implement holder as in FIG. 1 in a closed configuration.

In use, the lid 26 may be pivoted about the guide pins 40 to a closed configuration (FIG. 2) so as to cover the open top 22 of the case 12 during storage or transport. In this configuration, for example, the writing implement holder 10 may be tucked away in a musical instrument case or other bag. When use is desired, a user may manipulate the lid 26 using the finger grips 39 so as to pivot the lid to expose the open top 22 (FIG. 3). Once the lid 26 has been pivoted, it may then be further urged such that the lid channels 34 slide along the guide pins 40 until the lock pins 42 are captured by the lock recesses 36. The writing implement holder 10 is now ready to be attached to a planar surface of a desired object, such as the lip of a music stand 8. The planar surface may be inserted between the free end of the clip member 44 and frictionally held between the face plate 28 and the clip member 44 (FIG. 1). The magnet 46 may further stabilize the attachment if the planar surface has a metallic construction. The pencil sharpener 48 may be conveniently utilized as needed.

Figure 5:
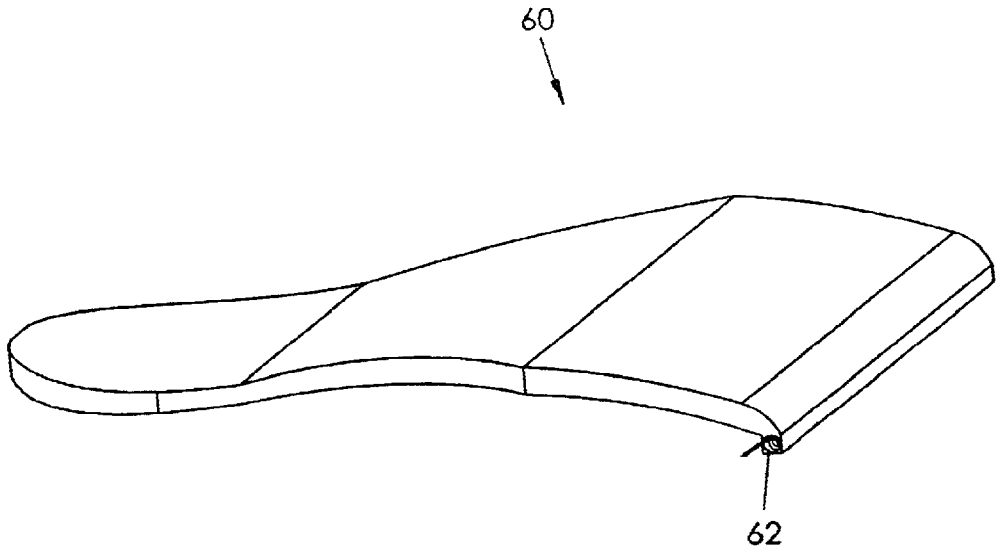
FIG. 5 is a perspective view on an enlarged scale of a clip member of a writing implement holder according to another embodiment of the present invention.

A writing implement holder according to another embodiment includes a clip member 60 that is attached to the face plate 28 with a torsion spring 62 such that the free end of the clip member 60 is spring-biased to sandwich a planar surface between the clip member 60 and the face plate0 (FIG. 5).

A writing implement holder 70 according to yet another embodiment is shown in FIG. 6 and includes a construction that is substantially similar to the construction first described except as specifically noted below. In this embodiment, the front wall of the case 76 is in the form of a door 72 pivotally coupled to a case side wall 78 with hinges 74. Thus, the front door 72 may be opened so as to insert or remove other writing accessories from the interior space of the case 76.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A writing implement holder, comprising:

a case having a bottom wall, a front and back wall extending longitudinally from said bottom wall, and opposed case side walls extending between said front and back walls, said case defining an interior space and an open top;

a pair of guide pins fixedly attached to respective case side walls, each guide pin being situated on a respective case side wall adjacent said open top and said back wall;

a lid having a face plate with a pair of opposed lid side walls depending from said face plate and an end wall interconnecting first ends of said lid side walls, each lid side wall defining an elongate channel extending longitudinally therealong, said pair of guide pins being situated in communication with respective channels for slidable movement therealong;

wherein said pair of guide pins define an imaginary lateral axis extending therebetween about which said lid is pivotally movable between a closed configuration in which said end wall covers said open top of said case and an open configuration in which said end wall is displaced from said open top;

a clip member attached to an outer surface of said face plate for selectively attaching said case to a planar surface; and wherein said front wall of said case is a door panel pivotally coupled to one of said case side walls and movable between open and closed configurations, whereby to provide selective access to said interior space.

2. The writing implement holder as in claim 1 wherein:

said case includes a pair of lock pins fixedly attached to respective case side walls, each lock pin being situated thereon adjacent said open top and generally adjacent a respective guide pin; and each lid side wall defines a recess adapted to receive a respective lock pin therein when said lid is at said open configuration and said guide pins are situated at distal ends of corresponding channels relative to said end wall of said lid.

3. The writing implement holder as in claim 1 wherein said clip member includes a free edge adjacent said end wall of said case such that the planar surface may be received between said free edge of said clip member and said front face of said lid.

4. The writing implement holder as in claim 1 further comprising a magnet mounted to said front face of said lid intermediate said front face and said clip member, said magnet adapted to inhibit movement of said case when said clip member is coupled to a metallic planar surface.

5. The writing implement holder as in claim 1 wherein said interior space of said case includes a first portion adapted to receive a plurality of writing instruments and a second portion adapted to hold an eraser adjacent said open top.

6. The writing implement holder as in claim 1 wherein said back wall of said case includes a length greater than a length of said front wall such that respective top edges of said case side walls are sloped between said front and back walls, whereby writing instruments may be conveniently removed from or inserted into said case.

7. The writing implement holder as in claim 1 further comprising means coupled to said case for sharpening a pencil.

8. The writing implement holder as in claim 7 further comprising means releasably coupled to said case and in communication with said pencil sharpening means for receiving pencil shavings therein.

9. A writing implement holder, comprising:

a case having a bottom wall and front and back walls extending longitudinally from said bottom wall with opposed case side walls extending between said front arid back walls, said case defining an interior space and an open top;

a lid pivotally coupled to said case for movement between a closed configuration covering said open top and an open configuration exposing said open top;

a clip member attached to said lid, said clip member adapted to releasably attach said case to a planar surface; and wherein said front wall is a door panel pivotally coupled to one of said case side walls and movable between open and closed configurations, whereby to provide selective access to said interior space of said case.

10. The writing implement holder as in claim 9 wherein:

said case includes a pair of lock pins fixedly attached to respective case side walls, each lock pin being situated adjacent said open top; and said lid includes a face plate with a pair of spaced apart lid side walls depending from said face plate and an end wall connecting first ends of said lid side walls, each lid side wall defining a recess adapted to receive a respective lock pin therein when said lid is at said open configuration.

11. The writing implement holder as in claim 9 further comprising a magnet mounted to an outer surface of said lid and positioned between said outer surface and said clip member, whereby to inhibit movement of said case when said clip member is coupled to a planar surface having a metallic construction.

12. The writing implement holder as in claim 9 wherein said interior space of said case includes a first portion adapted to hold a plurality of writing instruments and a second portion adapted to hold an eraser, said first and second portions being in communication with said open top.

13. The writing implement holder as in claim 9 wherein:

said lid includes a face plate with a pair of spaced apart lid side walls depending from said face plate and an end wall connecting first ends of said lid side walls;

said case includes a pair of guide pins fixedly attached to respective case side walls, each guide pin being situated adjacent said open top and said back wall of said case;

each lid side wall defines an elongate track, said guide pins being in communication with respective tracks for longitudinal slidable movement therealong; and said pair of guide pins define an imaginary lateral axis extending therebetween about which said lid is pivotally movable between said open and closed configurations.

14. The writing implement holder as in claim 13 wherein:

said case includes a pair of lock pins fixedly attached to respective case side walls, each lock pin being situated adjacent said open top; and said lid includes a face plate with a pair of spaced apart lid side walls depending from said face plate and an end wall connecting first ends of said lid side walls, each lid side wall defining a recess adapted to receive a respective lock pin therein when said lid is in said open configuration and slidably moved such that said pair of guide pins are situated at distal ends of corresponding tracks relative to said end wall of said lid.

15. The writing implement holder as in claim 13 wherein said clip member includes a free end adjacent said end wall of said lid.

16. The writing implement holder as in claim 9 further comprising means attached to said case for sharpening a pencil.

17. The writing implement holder as in claim 16 further comprising means releasably coupled to said case and in communication with said pencil sharpening means for receiving pencil shavings therein.

* * * * *